US006360499B1

(12) United States Patent
Sugiura

(10) Patent No.: US 6,360,499 B1
(45) **Date of Patent: *Mar. 26, 2002**

(54) SHEET GLASS ATTACHING CONSTRUCTION

(75) Inventor: Kiminari Sugiura, Ichihara (JP)

(73) Assignee: Nippon Sheet Glass Co. Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/117,024

(22) PCT Filed: Nov. 17, 1997

(86) PCT No.: PCT/JP97/04181

§ 371 Date: Jul. 20, 1998

§ 102(e) Date: Jul. 20, 1998

(87) PCT Pub. No.: WO98/23839

PCT Pub. Date: Jun. 4, 1998

(30) Foreign Application Priority Data

Nov. 25, 1996 (JP) ..... 8-313222

(51) Int. Cl.[7] ..... E06B 3/54; E06B 5/10

(52) U.S. Cl. ..... 52/204.597; 52/204.67; 52/204.7

(58) Field of Search ..... 52/204.591, 204.597, 52/204.599, 204.62, 204.63, 204.67, 204.69, 204.7

(56) References Cited

U.S. PATENT DOCUMENTS

| | | | | | |
|---|---|---|---|---|---|
| 2,348,937 | A | * | 5/1944 | Stahl | 52/204.597 |
| 3,086,626 | A | * | 4/1963 | Bowers | 52/204.599 |
| 3,981,118 | A | * | 9/1976 | Johnson et al. | 52/204.591 |
| 4,006,569 | A | * | 2/1977 | Kain | 52/204.597 |
| 4,407,105 | A | * | 10/1983 | Frank | 52/204.591 |
| 4,424,653 | A | * | 1/1984 | Heinen | 52/204.597 |
| 4,775,570 | A | * | 10/1988 | Ohlenforst et al. | 52/204.591 |
| 4,920,717 | A | * | 5/1990 | Hooper, Jr. | 52/204.597 |
| 4,987,713 | A | * | 1/1991 | Delafield | 52/204.597 |
| 5,494,720 | A | * | 2/1996 | Smith et al. | 428/57 |

FOREIGN PATENT DOCUMENTS

| | | |
|---|---|---|
| JP | 7324557 | 12/1995 |
| JP | 8270330 | 10/1996 |

* cited by examiner

*Primary Examiner*—Michael Safavi
(74) *Attorney, Agent, or Firm*—Fulbright & Jaworski L.L.P.

(57) ABSTRACT

A sheet glass attaching construction for attaching a sheet glass to a fixed member having a concave groove capable of receiving a peripheral edge of the sheet glass. In the case of a conventional sheet glass attaching construction, the sheet glass tends to come off the fixed member in the event of e.g. a fire. However, if a pair of engaging portions (3*b*, 5) are provided in the fixed member (3) and the peripheral edge of the sheet glass respectively, the engaging portions coming into engagement with each other when the sheet glass (2) is fitted into the concave groove (3*a*), thereby to prevent the sheet glass (2) from coming off the concave groove (3*a*); then, it is possible to prevent the sheet glass from coming off the fixed member in the event of a fire or the like.

6 Claims, 1 Drawing Sheet

SHEET GLASS ATTACHING CONSTRUCTION

BACKGROUND AND SUMMARY OF THE INVENTION

The present invention relates to a sheet glass attaching construction for attaching a sheet glass to a fixed member having a concave groove capable of receiving a peripheral edge of the sheet glass.

Conventionally, in a sheet glass attaching construction of this kind, as shown in FIG. 2, a sheet glass 2 is simply fitted into a fixed member 1A having a concave groove capable of receiving a peripheral edge of the sheet glass 2. And, after charging a filling material 7 such as of ceramic fiber into the concave groove 3*a*, a gap between the concave groove 3*a* and the peripheral edge is sealed with a sealant 6 or the like.

However, with the above-described sheet glass attaching construction, if a window glass is formed using this construction, the construction allows simple and easy installment by simply installing the fixed member, the sheet glass, the filling material and the sealant one after another. However, when the construction is subjected to a stress which pulls the sheet glass out of the concave groove, the sheet glass tends to be removed from the concave groove relatively easily. Normally, because of the rigidity of the sheet glass, such stress will not be applied to the concave groove of the sheet glass attaching construction. However, in the case of occurrence of a fire for instance, the sheet glass will be softened and readily deformed and the sheet glass may be bent due to its own weight. In that case, a pulling tension will be applied from the sheet glass to the concave groove. As a result, there sometimes develops a stress that pulls the sheet glass out of the groove.

In the occurrence of a fire, if such situation develops, the bending deformation or the like will cause the sheet glass to come off the fixed member, thus establishing communication between two spaces which were partitioned from each other by the sheet glass, so that the fire will spread to the adjacent space, causing a problem in the disaster prevention.

Incidentally, in order to solve such problem relating to the disaster prevention, an attempt has been made to prevent fire spreading by means of e.g. heat tempering. However, glasses having low softening points, such as soda-lime glass, have tended to receive low evaluation as a fire retarding door due to the above-described problem especially.

In view of the above-described drawbacks present in the prior art, an object of the present invention is to provide a sheet glass attaching construction which effectively restricts falling of the sheet glass off the fixed member even when the sheet glass becomes softened due to heat such as of a fire, and also to provide a glass window having a high fire retarding performance.

In order to achieve the above object, according to the characterizing features of a sheet glass attaching construction of the present invention, in a sheet glass attaching construction including a fixed member having a concave groove capable of receiving a peripheral edge of the sheet glass;

a pair of engaging portions are provided in the fixed member and the peripheral edge of the sheet glass respectively, the engaging portions coming into engagement with each other when the sheet glass is fitted into the concave groove, thereby to prevent the sheet glass from coming off the concave groove.

With the sheet glass attaching construction, of the invention even if a stress is developed to urge the sheet glass to come off the concave groove, the pair of engaging portions effectively resist this stress and prevents the sheet glass from coming off the concave groove. Therefore, even if the sheet glass becomes softened due to occurrence of a fire and deformed because of its self-weight, unless the stress applied to the sheet glass attaching construction due to the deformation exceeds the engagement force between the engaging portions, the force will not be sufficient to pull the sheet glass out of the concave groove. As a result, it is possible to reliably prevent the sheet glass from coming off the concave groove, thus prevent spread of the fire.

Further, at a side edge portion of the concave groove along a longitudinal direction thereof, there may be provided a projecting portion which projects in a direction to approach the sheet glass to be fitted into the concave groove, thus retaining the sheet glass fitted into the concave groove; and a fire-resistant adhesive having adhesiveness for glass may be charged within the concave groove.

As the fire-resistant adhesive having glass adhesive property referred to herein, so-called ceramic adhesive agents may be employed. For instance, an agent having a following composition given in the unit of wt. % may be employed; namely,

| | | |
|---|---|---|
| sodium silicate | ($Na_2O.nSiO_2.XH_2O$) | about 15% |
| silica | ($SiO_2$) | about 50% |
| alumina | ($Al_2O_3$) | about 35% |
| alkali | ($R_2O$: R is an alkaline metal) | <2% |

Incidentally, the fixed member may comprise a sheet glass holding member for securing the sheet glass to a window-glass fixing frame.

In the above, as the pair of engaging portions described above, it is conceivable to effect treatment on both an end portion of the sheet glass and the concave groove to provide them with the engaging portions. In particular, it is preferred that at a side edge portion of the concave groove along a longitudinal direction thereof, there be provided a projecting portion which projects in a direction to approach the sheet glass to be fitted into the concave groove, thus retaining the sheet glass fitted into the concave groove; and a fire-resistant adhesive having adhesiveness for glass be charged within the concave groove. With this, when the sheet glass is to be installed, the installment may be readily carried out by applying the fire-resistant adhesive to the fixed member and then fitting the sheet glass into the concave groove. Moreover, after the installment, the fire-resistant adhesive will be integrated with the glass. So that, when the sheet glass is urged to come off the concave groove, it engages with the projecting portion within the concave groove, whereby the projecting portion and the fire-resistant adhesive act as the pair of engaging portions. Therefore, a sheet glass attaching construction achieving the above-described function may be readily obtained advantageously.

Incidentally, in the above, the fire-resistant adhesive will be integrated with the end portion of the sheet glass upon installment of the sheet glass. Further, in the event of a fire, when the sheet glass is urged to come off the concave groove, it will engage with the projecting portion, thus preventing the sheet glass from coming off. In this respect, supposing a situation when even the end portion of the sheet glass begins to soften, the sheet glass and the fire-resistant adhesive will be even more integrated with each other, thus preventing the fluidized sheet glass from coming off the concave groove.

Further, a glass window according to the present invention for achieving the above-noted object is characterized in that the above-described sheet glass attaching construction is employed at least at an upper end portion of the glass window.

DETAILED DESCRIPTION

Next, an embodiment of the present invention will be described in details with reference to FIG. 1, by way of an example where a sheet glass is attached to a window frame for forming a window glass.

Figure 1:
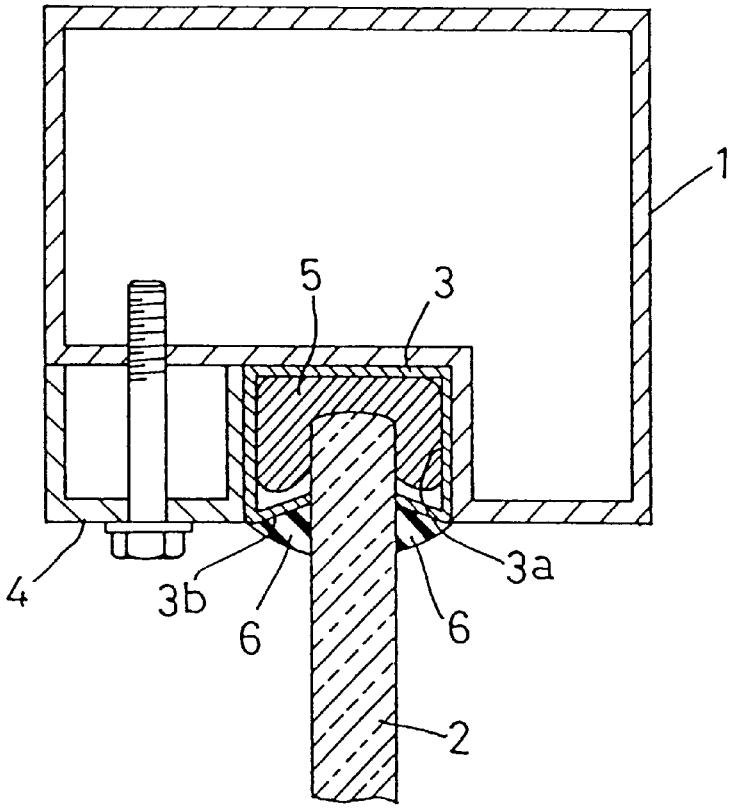
FIG. 1 is a vertical sectional view of a window glass relating to one embodiment of the present invention.
Figure 2:
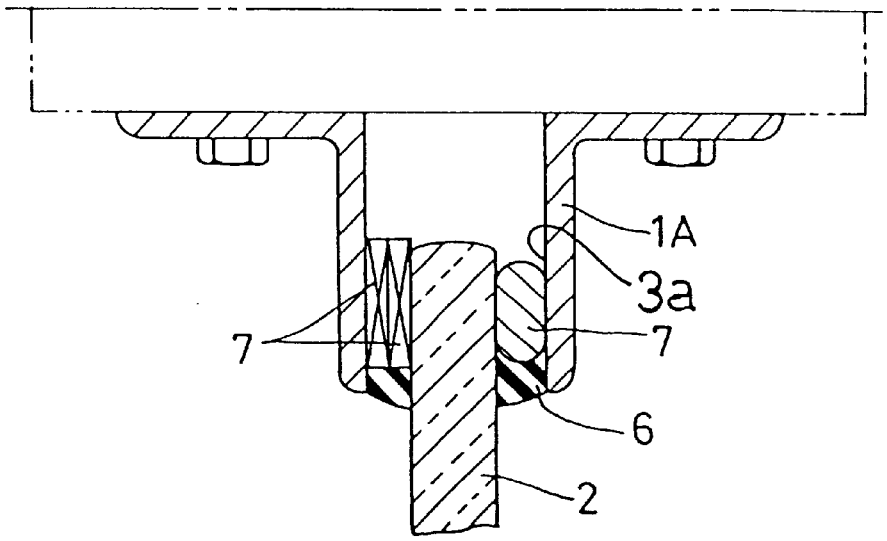
FIG. 2 (PRIOR ART)
FIG. 2 is a vertical sectional view of a conventional sheet glass attaching construction.

The window frame 1 is made of steel and comprises, as shown in FIG. 1, an assembly of channel-shaped sheet glass holder members 3 constituting respectively the upper, lower, left and right side portions. In this respect, the window frame 1 is not limited to the one made of steel, but may be formed of other materials such as an aluminum alloy or the like. Further, the sheet glass holder members 3 will be attached respectively as being bound and fixed between a bead 4 bolt-fixed to the window frame 1 and the window frame 1.

The sheet glass holding member 3 is provided as an integral member having a concave groove 3*a* capable of receiving a peripheral edge of the sheet glass 2, and at a peripheral edge portion of this concave groove 3*a*, there is provided projecting portions 3*b* each of which projects in a direction to approach the sheet glass 2 to be fitted within the concave groove 3*a*. Preferably, as shown in FIG. 1, the leading ends of the projecting portions 3*b* are bent toward the peripheral edge of the sheet glass along the inserting direction of the sheet glass 2 into the concave groove 3*a*. More preferably, the projecting portions 3*b* are bent in not a curved form but a straight form to come into abutment against the opposed faces of the sheet glass. With this, when a fire-resistant adhesive 5 is charged to adhere to both the sheet glass 2 and the sheet glass holder member 3 and then the sheet glass 2 is fitted therein, the fire-resistant adhesive 5 and the projecting portions 3*b* provide a pair of engaging portions for strictly preventing the sheet glass 2 from coming off the concave groove 3*a*. Further, in the vicinity of the contacting portion between the outer side of the concave groove 3*a* of the sheet glass holder member 3 and the sheet glass 2, there is charged a sealant 6 of silicone rubber or the like for sealing.

As the fire-resistant adhesive having glass adhesive property referred to herein, so-called ceramic adhesive agents may be employed. For instance, an agent having a following composition expressed in the unit of wt. % may be employed; namely,

| | | |
|---|---|---|
| sodium silicate | ($Na_2O.nSiO_2.XH_2O$) | about 15% |
| silica | ($SiO_2$) | about 50% |
| alumina | ($Al_2O_3$) | about 35% |
| alkali | ($R_2O$: R is an alkaline metal) | <2% |

As the sheet glass, there is employed, for instance, a sheet glass having any one of compositions Nos. 1–9 shown in Table 1. The numerical values relating the respective compositions are given in the unit of wt. %.

For providing the above-described sheet glass attaching construction, first, of the sheet glass holder members 3, into at least one of them constituting the upper side of the window glass, the ceramic adhesive 5 is charged. Under this condition, the glass and the holder member are assembled together by fitting a peripheral edge of the sheet glass 2 into the concave groove 3*a*. As for the other sides too, if the sheet glass holder members 3 are assembled one after another in the same manner as above, the same sheet glass attaching constructions may be provided.

In the foregoing embodiment, the sheet glass attaching construction is provided by using the sheet glass holder member 3 for attaching the sheet glass 2. Instead, the sheet glass 2 may be directly installed to the window frame (window glass fixing frame) 1.

Further, the pair of engaging portions for preventing the sheet glass 2 from coming off the concave groove 3*a* may be provided alternatively by forming, in the peripheral edge of the sheet glass 2, a hooking portion engageable with the projecting portions 3*b*. Hence, the means for providing the engaging portions may vary in many ways. However, with the above-described embodiment, there is no risk of the hooking portion, due to is fire resistance, becoming deformed by heat in the event of fire, and this construction allows easy installment. In these respects, there may be provided a sheet glass attaching construction which is simple and reliable also.

TABLE 1

| | 1 | 2 | 3 | 4 | 5 | 6 | 7 | 8 | 9 |
|---|---|---|---|---|---|---|---|---|---|
| $SiO_2$ | 62.0 | 61.0 | 65.0 | 64.9 | 62.4 | 60.2 | 60.0 | 57.0 | 72.1 |
| $Al_2O_3$ | 4.8 | 3.0 | 1.2 | 1.3 | 1.2 | 3.8 | 0.3 | 0.6 | 1.5 |
| MgO | 3.5 | 3.5 | 4.6 | 3.7 | 4.6 | 3.0 | 3.5 | 2.0 | 4.1 |
| CaO | 7.0 | 7.0 | 9.0 | 7.5 | 9.0 | 6.0 | 7.4 | 11.0 | 8.2 |
| SrO | 3.0 | 6.0 | 6.0 | 6.0 | 6.0 | 5.0 | 1.8 | 4.5 | 0.0 |
| BaO | 7.0 | 6.0 | 5.0 | 5.0 | 5.0 | 8.0 | 12.0 | 9.4 | 0.0 |
| ZnO | 0.5 | 0.0 | 0.0 | 0.0 | 0.0 | 0.0 | 0.0 | 0.0 | 0.0 |
| $Li_2O$ | 0.0 | 0.0 | 0.0 | 0.0 | 0.0 | 0.2 | 0.0 | 0.0 | 0.0 |
| $Na_2O$ | 3.6 | 3.0 | 2.8 | 1.7 | 2.8 | 2.0 | 1.8 | 3.8 | 13.0 |
| $K_2O$ | 7.5 | 9.0 | 6.2 | 9.5 | 6.8 | 8.0 | 12.0 | 9.8 | 1.0 |
| $ZrO_2$ | 0.5 | 1.5 | 0.0 | 0.3 | 2.0 | 2.8 | 0.5 | 1.1 | 0.0 |
| $SnO_2$ | 0.0 | 0.0 | 0.0 | 0.0 | 0.0 | 0.2 | 0.0 | 0.0 | 0.0 |
| $TiO_2$ | 0.3 | 0.0 | 0.0 | 0.0 | 0.0 | 0.6 | 0.5 | 0.5 | 0.0 |
| $Fe_2O_3$ | 0.1 | 0.0 | 0.1 | 0.0 | 0.0 | 0.1 | 0.0 | 0.1 | 0.1 |
| $SO_3$ | 0.2 | 0.0 | 0.1 | 0.1 | 0.2 | 0.1 | 0.2 | 0.2 | 0.0 |
| Total | 100.0 | 100.0 | 100.0 | 100.0 | 100.0 | 100.0 | 100.0 | 100.0 | 100.0 |

TABLE 1-continued

| | 1 | 2 | 3 | 4 | 5 | 6 | 7 | 8 | 9 |
|---|---|---|---|---|---|---|---|---|---|
| $R_2O$ ($Na_2O$ + $K_2O$) | 11.1 | 12.0 | 9.0 | 11.2 | 9.6 | 10.0 | 13.8 | 13.6 | 14.0 |
| MgO + CaO | 10.5 | 10.5 | 13.6 | 11.2 | 13.6 | 9.0 | 10.9 | 13.0 | 12.3 |
| SrO + BaO | 10.0 | 12.0 | 11.0 | 11.0 | 11.0 | 13.0 | 13.8 | 13.9 | 0.0 |
| RO (MgO + CaO + SrO + BaO) | 20.5 | 22.5 | 24.6 | 22.2 | 24.6 | 22.0 | 24.7 | 26.9 | 12.3 |
| melting temperature (° C.) | 1542 | 1528 | 1520 | 1535 | 1497 | 1525 | 1523 | 1511 | 1462 |
| working temperature (° C.) | 1139 | 1119 | 1125 | 1127 | 1096 | 1120 | 1130 | 1098 | 1039 |
| devitrification temperature (° C.) | 1115 | 1105 | 1100 | 1080 | 1092 | 1090 | 1119 | 1082 | 991 |
| softening point (° C.) | 824 | 809 | 820 | 820 | 812 | 808 | 830 | 788 | 738 |
| distortion point (° C.) | 571 | 563 | 575 | 578 | 596 | 558 | 590 | 545 | 509 |
| coefficient of thermal expansion $\times 10^{-7}$ (/K) | 86 | 89 | 79 | 84 | 81 | 85 | 86 | 92 | 86 |
| water resistance (%) | 0.3 | 0.3 | 0.4 | 0.5 | 0.5 | 0.3 | 1.1 | 0.8 | 0.4 |
| devitrification adjacent brick | Δ | ○ | ○ | ○ | ○ | ○ | ○ | Δ | ○ |

What is claimed is:

1. An assembly comprising:

a sheet of glass having a peripheral edge;

a sheet glass holding member having a concave groove capable of receiving said peripheral edge of said glass sheet therein; and a fire-resistant ceramic adhesive comprising silica ($SiO_2$) as a component thereof charged within said concave groove;

wherein said sheet glass holding member further comprises a projecting portion formed at a side edge of said concave groove along a longitudinal direction thereof, said projecting portion being bent straight in a direction in which said sheet glass is fitted into said concave groove, and coming into abutment with said sheet glass so as to prevent withdrawal of said adhesive from said concave groove.

2. The assembly of claim 1, wherein said adhesive comprises about 50% silica.

3. A sheet glass attaching construction for holding at least an upper side of a sheet glass, the construction comprising:

a sheet glass holding member having a concave groove capable of receiving a peripheral edge of the sheet glass therein; and a fire-resistant ceramic adhesive comprising approximately 50 weight % of silica ($SiO_2$) as a main component thereof, said adhesive being charged within the concave groove;

wherein the sheet glass holding member further includes a projecting portion formed at a side edge of the concave groove along a longitudinal direction thereof, the projecting portion being bent straight in a direction in which the sheet glass is to be fitted into the concave groove, and coming into abutment with the sheet glass so as to prevent withdrawal of the charged adhesive from the concave groove.

4. A sheet glass attaching construction for holding at least an upper side of a sheet glass, the construction comprising:

a sheet glass holding member having a concave groove capable of receiving a peripheral edge of a glass sheet therein; and a fire-resistant ceramic adhesive comprising silica ($SiO_2$) as a main component thereof charged within the concave groove;

wherein said sheet glass holding member further comprises a projecting portion formed at a side edge of the concave groove along a longitudinal direction thereof, said projecting portion being bent straight in a direction in which the sheet glass is to be fitted into said concave groove, and coming into abutment with the sheet glass so as to prevent withdrawal of said adhesive from said concave groove.

5. The sheet glass attaching construction of claim 4, wherein said sheet glass holding member is fixedly bound between a window frame made of at least one of steel and aluminum alloy and a bead bolt-fixed to said window frame.

6. The sheet glass attaching construction of claim 4, wherein said adhesive comprises about 50% silica ($SiO_2$)by weight.

* * * * *